US009587518B2

(12) United States Patent
Oleson

(10) Patent No.: US 9,587,518 B2
(45) Date of Patent: Mar. 7, 2017

(54) BALL AND SOCKET FAN MOUNT

(71) Applicant: Delta T Corporation, Lexington, KY (US)

(72) Inventor: Richard A. Oleson, Lexington, KY (US)

(73) Assignee: DELTA T CORPORATION, Lexington, KY (US)

( * ) Notice: Subject to any disclaimer, the term of this patent is extended or adjusted under 35 U.S.C. 154(b) by 854 days.

(21) Appl. No.: 13/790,646

(22) Filed: Mar. 8, 2013

(65) Prior Publication Data

US 2013/0251522 A1 Sep. 26, 2013

Related U.S. Application Data

(60) Provisional application No. 61/613,146, filed on Mar. 20, 2012.

(51) Int. Cl.

| | |
|---|---|
| ***F04D 29/62*** | (2006.01) |
| ***F01D 25/28*** | (2006.01) |
| ***F04D 25/08*** | (2006.01) |
| ***F04D 29/60*** | (2006.01) |

(52) U.S. Cl.
CPC ..... *F01D 25/28* (2013.01); *F04D 25/088* (2013.01); *F04D 29/601* (2013.01)

(58) Field of Classification Search
CPC ..... F01D 25/28; F04D 29/601; F04D 25/088
USPC ..... 415/213.1
See application file for complete search history.

(56) References Cited

U.S. PATENT DOCUMENTS 4,356,998 A * 11/1982 Bach ..... F16K 25/00 119/75
7,080,813 B1 * 7/2006 Frampton ..... F04D 25/088 248/342
7,621,498 B2 * 11/2009 Tang ..... F04D 29/60 248/317

OTHER PUBLICATIONS

The Edgewood Standard Ceiling Fan Model No. TF100 ** Owner's Manuel Copyright 2007 Fanimation (Zionsville, Indiana).

* cited by examiner

*Primary Examiner* — Zelalem Eshete
(74) *Attorney, Agent, or Firm* — King & Schickli, PLLC

(57) ABSTRACT

A fan mounting assembly has a mount, a ball member, and a support. The support is disposed within a vertical opening of the ball member and is coupled to the ball member. The mounting assembly may further comprise a wedge driven between an interior surface of the ball member and an exterior surface of the support in order to prevent movement of the support within the ball member. The mount has a mounting portion and a socket portion. The socket portion has a tapered interior surface. The tapered surface may have a constant angle. The ball member and support are disposed within the socket portion such that an outer surface of the ball member rests upon the tapered surface of the socket portion. The tapered surface may have features configured to prevent rotation of the ball member within the socket portion.

16 Claims, 6 Drawing Sheets

BALL AND SOCKET FAN MOUNT

PRIORITY

This application claims priority to U.S. Provisional Patent Application No. 61/613,146, entitled "Ball and Socket Fan Mount," filed Mar. 20, 2012, the disclosure of which is incorporated by reference herein.

BACKGROUND

A variety of fan systems have been made and used over the years in a variety of contexts. For instance, various ceiling fans are disclosed in U.S. Pat. No. 7,284,960, entitled "Fan Blades," issued Oct. 23, 2007; U.S. Pat. No. 6,244,821, entitled "Low Speed Cooling Fan," issued Jun. 12, 2001; U.S. Pat. No. 6,939,108, entitled "Cooling Fan with Reinforced Blade," issued Sep. 6, 2005; and U.S. Pat. No. D607,988, entitled "Ceiling Fan," issued Jan. 12, 2010. The disclosures of each of those U.S. patents are incorporated by reference herein. Additional exemplary fans are disclosed in U.S. Pat. No. 8,079,823, entitled "Fan Blades," issued Dec. 20, 2011; U.S. Pat. Pub. No. 2009/0208333, entitled "Ceiling Fan System with Brushless Motor," published Aug. 20, 2009; and U.S. Pat. Pub. No. 2010/0278637, entitled "Ceiling Fan with Variable Blade Pitch and Variable Speed Control," published Nov. 4, 2010, the disclosures of which are also incorporated by reference herein. It should be understood that teachings herein may be incorporated into any of the fans described in any of the above-referenced patents, publications, or patent applications A fan blade or airfoil may include one or more upper air fences and/or one or more lower air fences at any suitable position(s) along the length of the fan blade or airfoil. Merely exemplary air fences are described in U.S. Pat. Pub. No. 2011/0081246, entitled "Air Fence for Fan Blade," published Apr. 7, 2011, the disclosure of which is incorporated by reference herein. Alternatively, any other suitable type of component or feature may be positioned along the length of a fan blade or airfoil; or such components or features may simply be omitted.

The outer tip of a fan blade or airfoil may be finished by the addition of an aerodynamic tip or winglet. Merely exemplary winglets are described in U.S. Pat. No. 7,252,478, entitled "Fan Blade Modifications," issued Aug. 7, 2007, the disclosure of which is incorporated by reference herein. Additional winglets are described in U.S. Pat. No. 7,934,907, entitled "Cuffed Fan Blade Modifications," issued May 3, 2011, the disclosure of which is incorporated by reference herein. Still other exemplary winglets are described in U.S. Pat. No. D587,799, entitled "Winglet for a Fan Blade," issued Mar. 3, 2009, the disclosure of which is incorporated by reference herein. In some settings, such winglets may interrupt the outward flow of air at the tip of a fan blade, redirecting the flow to cause the air to pass over the fan blade in a perpendicular direction, and also ensuring that the entire air stream exits over the trailing edge of the fan blade and reducing tip vortex formation. In some settings, this may result in increased efficiency in operation in the region of the tip of the fan blade. In other variations, an angled extension may be added to a fan blade or airfoil, such as the angled airfoil extensions described in U.S. Pat. Pub. No. 2008/0213097, entitled "Angled Airfoil Extension for Fan Blade," published Sep. 4, 2008, and issued Apr. 24, 2012 as U.S. Pat. No. 8,162,613, the disclosure of which is incorporated by reference herein. Other suitable structures that may be associated with an outer tip of an airfoil or fan blade will be apparent to those of ordinary skill in the art. Alternatively, the outer tip of an airfoil or fan blade may be simply closed (e.g., with a cap or otherwise, etc.), or may lack any similar structure at all.

The interface of a fan blade and a fan hub may also be provided in a variety of ways. For instance, various interfaces are described in U.S. Pat. Pub. No. 2009/0081045, entitled "Aerodynamic Interface Component for Fan Blade," published Mar. 26, 2009 and issued Apr. 3, 2012 as U.S. Pat. No. 8,147,204; and U.S. Provisional Patent Appln. No. 61/590,469, entitled "Fan with Resilient Hub," filed Jan. 25, 2012, the disclosure of which is incorporated by reference herein. In addition, or in the alternative, the fan blade may include a retention system that couples the tip of a fan blade to an attachment point on the fan hub via a cable running through the fan blade, such as that disclosed in U.S. Pat. Pub. No. 2011/0262278, entitled "Fan Blade Retention System," published Oct. 27, 2011. Alternatively, the interface of a fan blade and a fan hub may include any other component or components, or may lack any similar structure at all.

It should also be understood that a fan may include sensors or other features that are used to control, at least in part, operation of a fan system. For instance, such fan systems are disclosed in U.S. Pat. Pub. No. 2009/0097975, entitled "Ceiling Fan with Concentric Stationary Tube and Power-Down Features," published Apr. 16, 2009, and issued Apr. 3, 2012 as U.S. Pat. No. 8,147,182, the disclosure of which is incorporated by reference herein; U.S. Pat. Pub. No. 2009/0162197, entitled "Automatic Control System and Method to Minimize Oscillation in Ceiling Fans," published Jun. 25, 2009, and issued Feb. 28, 2012 as U.S. Pat. No. 8,123,479, the disclosure of which is incorporated by reference herein; U.S. Pat. Pub. No. 2010/0291858, entitled "Automatic Control System for Ceiling Fan Based on Temperature Differentials," published Nov. 18, 2010, the disclosure of which is incorporated by reference herein; and U.S. Provisional Patent Appln. No. 61/165,582, entitled "Fan with Impact Avoidance System Using Infrared," filed Apr. 1, 2009, the disclosure of which is incorporated by reference herein. Alternatively, any other suitable control systems/features may be used in conjunction with embodiments described herein.

Fans may also include a variety of mounting structures. For instance, a fan mounting structure is disclosed in U.S. Pat. Pub. No. 2009/0072108, entitled "Ceiling Fan with Angled Mounting," published Mar. 19, 2009, and issued Apr. 10, 2012 as U.S. Pat. No. 8,152,453, the disclosure of which is incorporated herein. Of course, a fan need not be mounted to a ceiling or other overhead structure, and instead may be mounted to a wall or to the ground. For instance, a fan may be supported on the top of a post that extends upwardly from the ground. Still other mounting structures may be used in conjunction with the embodiments described herein.

While several systems and methods have been made and used for ceiling fan blades, it is believed that no one prior to the inventors has made or used the invention described in the appended claims.

BRIEF DESCRIPTION OF THE DRAWINGS

While the specification concludes with claims which particularly point out and distinctly claim this technology, it is believed this technology will be better understood from the following description of certain examples taken in conjunction with the accompanying drawings, in which like reference numerals identify the same elements and in which:

Figure 1:
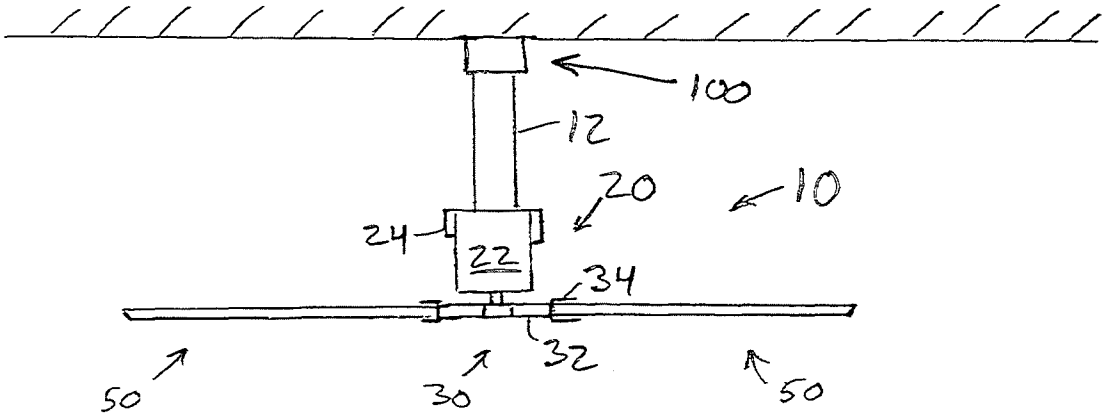
FIG. 1 depicts a schematic view of an exemplary fan mounted to a ceiling with an exemplary ball and socket mounting assembly.

The drawings are not intended to be limiting in any way, and it is contemplated that various embodiments of the technology may be carried out in a variety of other ways, including those not necessarily depicted in the drawings. The accompanying drawings incorporated in and forming a part of the specification illustrate several aspects of the present technology, and together with the description serve to explain the principles of the technology; it being understood, however, that this technology is not limited to the precise arrangements shown.

DETAILED DESCRIPTION

The following description of certain examples of the technology should not be used to limit its scope. Other examples, features, aspects, embodiments, and advantages of the technology will become apparent to those skilled in the art from the following description, which is by way of illustration, one of the best modes contemplated for carrying out the technology. As will be realized, the technology described herein is capable of other different and obvious aspects, all without departing from the technology. Accordingly, the drawings and descriptions should be regarded as illustrative in nature and not restrictive.

I. Exemplary Fan Overview

FIG. 1 depicts an exemplary fan (10) having a motor assembly (20), a hub assembly (30) coupled to motor assembly (20), and a plurality of fan blades (50) coupled to hub assembly (30). In the present example, fan (10) (including hub assembly (30) and fan blades (50)) has a diameter of approximately 5 feet. In some versions, fan (10) has a diameter of approximately 7 feet. In other variations, fan (10) has a diameter between approximately 6 feet, inclusive, and approximately 24 feet, inclusive. Further still, fan (10) may have any other suitable dimensions, such as 3 feet, inclusive, to 30 feet, inclusive. Except as otherwise described herein, fan (10) may be constructed and operable in accordance with at least some of the teachings of any of the references that are cited herein; and/or in any other suitable fashion.

Motor assembly (20) is operably coupled to hub assembly (30) such that motor assembly (20) rotates hub assembly (30) relative to motor assembly (30). It should be understood that when fan blades (50) are coupled to hub assembly (30), motor assembly (20) rotates fan blades (50) with hub assembly (30). Motor assembly (20) of the present example comprises a motor (22) and a frame (24). Motor (22) may comprise a permanent magnet brushless DC motor having a drive shaft that is coupled to hub assembly (30), though it should be understood that motor (22) may alternatively comprise any other suitable type of motor (e.g., an AC induction motor, a brushed motor, an inside-out motor, etc.). By way of example only, motor assembly (20) may be constructed in accordance with at least some of the teachings of U.S. Pat. Pub. No. 2009/0208333, entitled "Ceiling Fan System with Brushless Motor," published Aug. 20, 2009, the disclosure of which is incorporated by reference herein. Furthermore, fan (10) may include control electronics that are configured in accordance with at least some of the teachings of U.S. Pat. Pub. No. 2010/0278637, entitled "Ceiling Fan with Variable Blade Pitch and Variable Speed Control," published Nov. 4, 2010, the disclosure of which is incorporated by reference herein. Alternatively, motor assembly (20) may have any other suitable components, configurations, functionalities, and operability, as will be apparent to those of ordinary skill in the art in view of the teachings herein.

Hub assembly (30) of the present example is rotatably coupled to motor (22) such that hub assembly (30) rotates relative to motor (22). In the present example, hub assembly (30) includes a central member (32) and a plurality of fan blade attachment members (34) extending radially from central member (32), though it should be understood that central member (32) is merely optional. Fan blade attachment members (34) are configured to couple to a first end of fan blades (50) such that rotation of hub assembly (30) also rotates fan blades (50). In the present example, fan blades (50) are coupled to fan blade attachment members (34) such that fan blades (50) have an angle of attack of approximately 10 degrees. Of course it should be understood that the angle of attack of fan blades (50) may be at other angles as well. For instance, from −20 degrees, inclusive, to +20 degrees, inclusive. Hub assembly (30) may be further constructed in accordance with at least some of the teachings of U.S. Pat. Pub. No. 2009/0081045, entitled "Aerodynamic Interface Component for Fan Blade," published Mar. 26, 2009, and issued Apr. 3, 2012 as U.S. Pat. No. 8,147,204; and U.S. Provisional Patent Appln. No. 61/590,469, entitled "Fan with Resilient Hub," filed Jan. 25, 2012, the disclosure of which is incorporated by reference herein. In addition, or in the alternative, hub assembly (30) may include a retention system that couples each tip of each fan blade (50) to an attachment point on hub assembly (30) via a cable running through each fan blade (50), such as that disclosed in U.S. Pat. Pub. No. 2011/0262278, entitled "Fan Blade Retention System," published Oct. 27, 2011. Alternatively, the interface of a fan blade and a fan hub may include any other component or components, or may lack any similar structure at all.

Fan (10) may be further configured in accordance with at least some of the teachings of the fan systems disclosed in U.S. Pat. Pub. No. 2009/0097975, entitled "Ceiling Fan with Concentric Stationary Tube and Power-Down Features," published Apr. 16, 2009, and issued Apr. 3, 2012 as U.S. Pat. No. 8,147,182, the disclosure of which is incorporated by reference herein; U.S. Pat. Pub. No. 2009/0162197, entitled "Automatic Control System and Method to Minimize Oscillation in Ceiling Fans," published Jun. 25, 2009, and issued Feb. 28, 2012 as U.S. Pat. No. 8,123,479, the disclosure of which is incorporated by reference herein; U.S. Pat. Pub. No. 2010/0291858, entitled "Automatic Control System for Ceiling Fan Based on Temperature Differentials," published Nov. 18, 2010, the disclosure of which is incorporated by reference herein; and U.S. Provisional Patent App. No. 61/165,582, entitled "Fan with Impact Avoidance System Using Infrared," filed Apr. 1, 2009, the disclosure of which is incorporated by reference herein. Of course still further configurations and/or constructions for fan (10) will be apparent to one of ordinary skill in the art in view of the teachings herein.

In the present example, frame (24) of motor assembly (20) is coupled to a support (12) that is adapted to couple fan (10) to a ceiling or other support structure via ball and socket mounting assembly (100), as will be described in greater detail below. By way of example only, support (12) and/or ball and socket mounting assembly (100) may include features of or be constructed in accordance with at least some of the teachings of U.S. Pat. Pub. No. 2009/0072108, entitled "Ceiling Fan with Angled Mounting," published Mar. 19, 2009, and issued Apr. 10, 2012 as U.S. Pat. No. 8,152,453, the disclosure of which is incorporated by reference herein, and/or in any other suitable configuration. In some versions, motor assembly (20) may be remote from hub assembly (30) and may be coupled via an axle or other component that is operable to transmit rotational movement from motor assembly (20) to hub assembly (30). Still other configurations will be apparent to one of ordinary skill in the art in view of the teachings herein.

Figure 2:
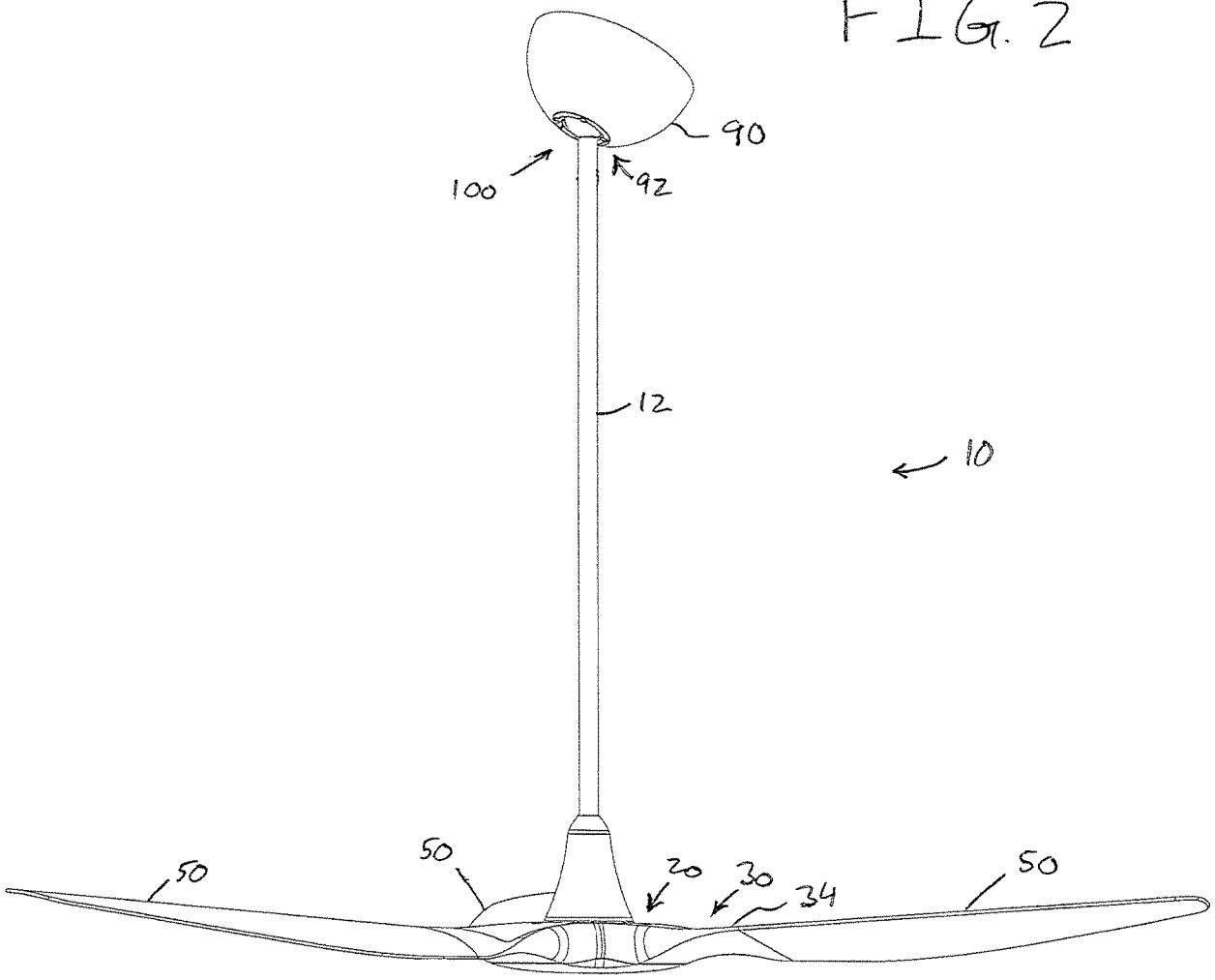
FIG. 2 depicts a side elevation view of the fan of FIG. 1 shown mounted at an angle with an exemplary cover.

FIG. 2 depicts fan (10) mounted at an angle via ball and socket mounting assembly (100) and support (12). Fan (10) includes three fan blades (50) coupled to a hub assembly (30) that is rotatable via a motor assembly (20). Fan (10) may be further constructed in accordance with at least some of the teachings of U.S. Pat. Pub. No. 2011/0165002, entitled "Ceiling Fan," published Jul. 7, 2011, the disclosure of which is incorporated by reference herein. In the present example, a cover (90) substantially shrouds ball and socket mounting assembly (100) such that only a portion of ball member (150), described in greater detail below, is exposed through cover (90). Cover (90) comprises a substantially hollow hemispherical cover with a central opening (92) to permit a portion of ball member (150) and support (12) to extend therethrough. In some versions, a seal may encircle opening (92) to substantially seal or otherwise limits the passage of material through any gaps between cover (90) and ball member (150). Such a seal may comprise a rubber (natural or synthetic), polymer, felt, or other material annular member that is positioned in or around opening (92). In addition, or in the alternative, the seal may comprise a plurality of fiber strands to form a brush-like ring about ball member (150). The seal may be coupled to cover (90) via a plurality of mechanical fasteners (e.g., screws, bolts, etc.), though this is merely optional. In some versions, the seal may be adhesively attached and/or inserted into a slot or other feature of cover (90) to retain the seal therein. In some versions the seal may be omitted entirely. Of course still other configurations for cover (90) and/or seal (94) will be apparent to one of ordinary skill in the art in view of the teachings herein.

As demonstrated in the example shown in FIG. 2, ball and socket mounting assembly (100) permits support (12) and fan (10) to pivot about various axes that are perpendicular to the longitudinal axis defined by support (12) such that fan (10) may be mounted to an angled ceiling, such as a cathedral ceiling or other non-level ceiling. Accordingly, fan (10) can substantially self-level via the weight of fan (10) during installation. Support (12) can thus maintain a substantially vertical position when fan (10) is installed.

II. Exemplary Ball and Socket Mounting Assembly

In some versions, it may be preferable to have fan (10) rotate in substantially all planes of freedom while suspended from a mounting surface. Such rotation may be accomplished by rotating about a single point. By having a single rotation and attachment point, a decorative cover, such as cover (90), having a very small opening for support (12) may be used while encasing any wiring and electrical connections in an area where fan (10) is attached to a ceiling or other mounting surface. In some versions, it may be desirable to limit some of the motion about this single point. For example, in a case where fan (10) is imperfectly balanced or where a slight breeze may blow fan (10), fan (10) may sway or oscillate. In such situations, it may be desirable for the mounting assembly of fan (10) to provide a degree of frictional resistance or damping to resist these motions while still retaining the ability to rotate in substantially all planes of freedom while suspended from a mounting surface. Such friction may be provided via ball and socket assembly (100), described below, such that the friction substantially prevents subsequent, inadvertent deviations of support (12) and/or fan (10) from a substantially vertical orientation.

Figure 3:
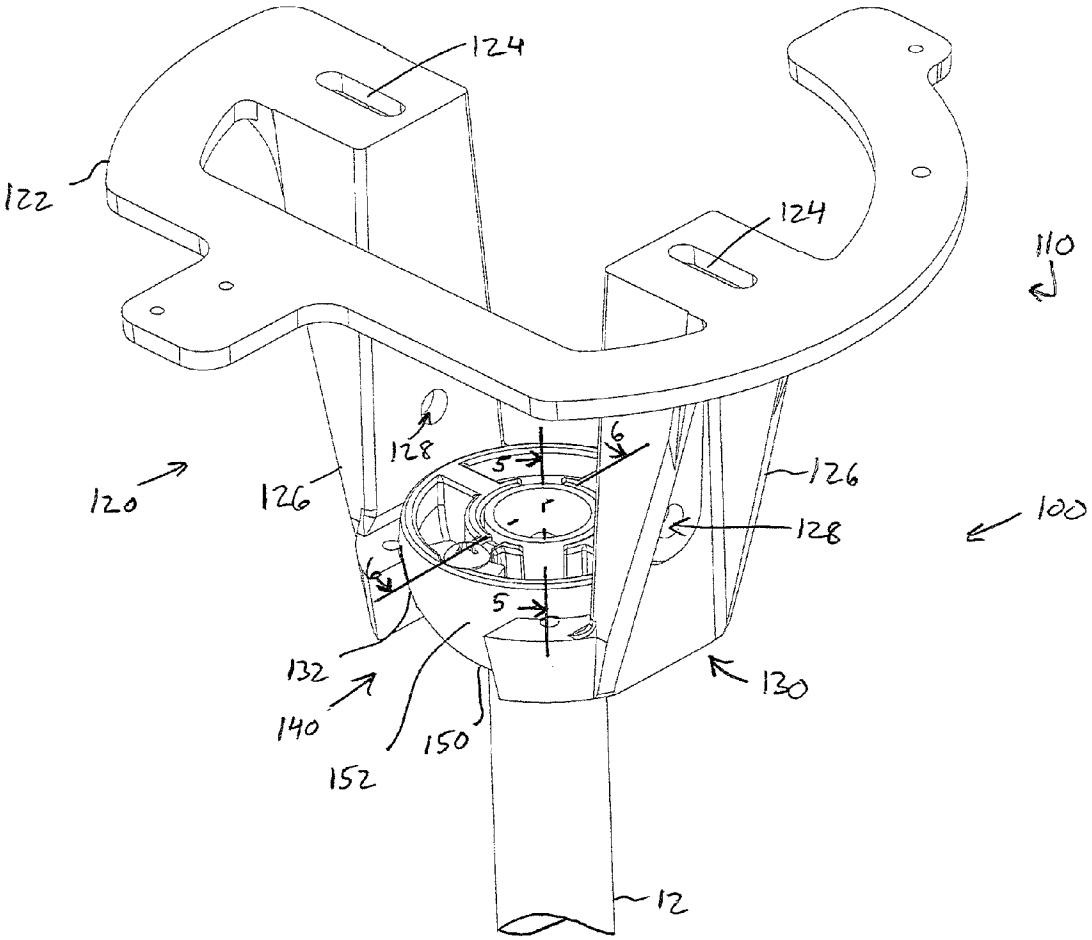
FIG. 3 depicts a perspective view of the ball and socket mounting assembly of FIG. 1.

FIGS. 3-6 depict an exemplary ball and socket mounting assembly (100) that couples support (12) of fan (10) to a ceiling or other mounting surface. As shown in FIG. 3, ball and socket mounting assembly comprises a mount (110) and a ball member (150) coupled to support (12). Mount (110) comprises a mounting portion (120) and a socket portion (130). In the present example mount (110) comprises a unitary metallic member configured to support fan (10), though it should be understood that mount (110) may be divided into discrete parts and/or made of other materials (e.g., polymers, ceramics, etc.). Mounting portion (120) comprises a substantially flat member (122) having one or more openings (124) through which a fastener (e.g., a screw, bolt, etc.) may be inserted to couple mounting portion (120) to a ceiling or other mounting surface. In the present example, openings (124) comprise slots to permit adjustment of the location of mount (110) relative to the ceiling or other mounting surface, though this is merely optional.

Flat member (122) comprises a substantially C-shaped member, though this is merely optional. In some versions, flat member (122) may be a rectangular, circular, ovular, and/or other plate having any other geometry. In addition, or in the alternative, flat member (122) need not necessarily be flat, but may be curved or have other non-planar features. Such features may be used to conform to a non-flat mounting surface, such as a curved ceiling. Flat member (122) is offset from socket portion (130) by a pair of stanchions (126). Stanchions (126) comprise U-shaped channels that extend downwardly from flat member (122). In the present example, the upper portions of the U-shaped channels taper as stanchions (126) extend downwardly, but this is merely optional. Stanchions (126) each include a lateral opening (128) to which one or more additional components may be attached, though this is merely optional. In some versions, lateral openings (128) may receive a bolt, pin, or other cross-wise member to secure the horizontal positions of stanchions (126) relative to one another. Stanchions (126) terminate at socket portion (130). In the present example, mounting portion (120) and socket portion (130) are unitary to form a single homogeneous continuum of material, though this is merely optional. In some versions mounting portion (120) is a separate piece that is mechanically or otherwise coupled to socket portion (130). Of course still other configurations will be apparent to one of ordinary skill in the art in view of the teachings herein.

Figure 4:
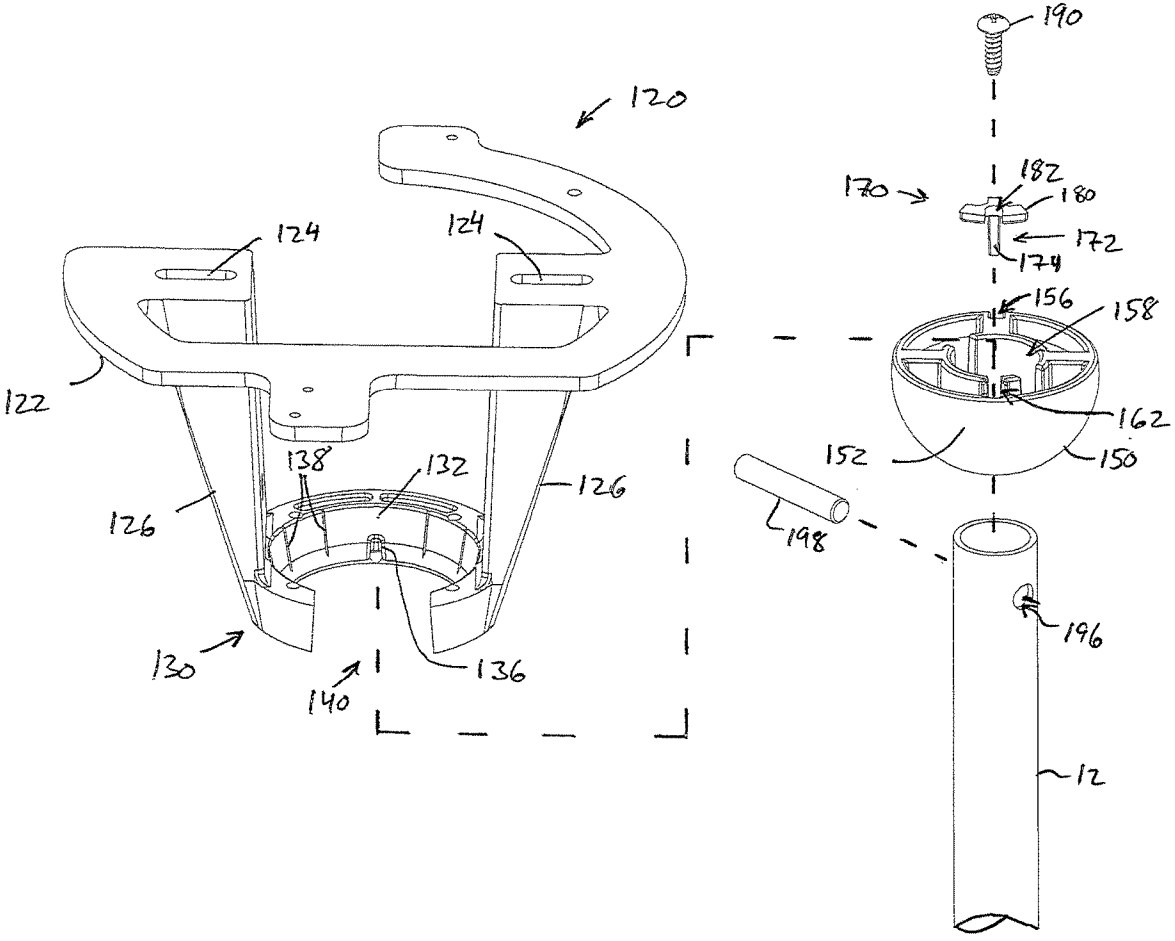
FIG. 4 depicts an exploded perspective view of the ball and socket mounting assembly of FIG. 3.
Figure 5:
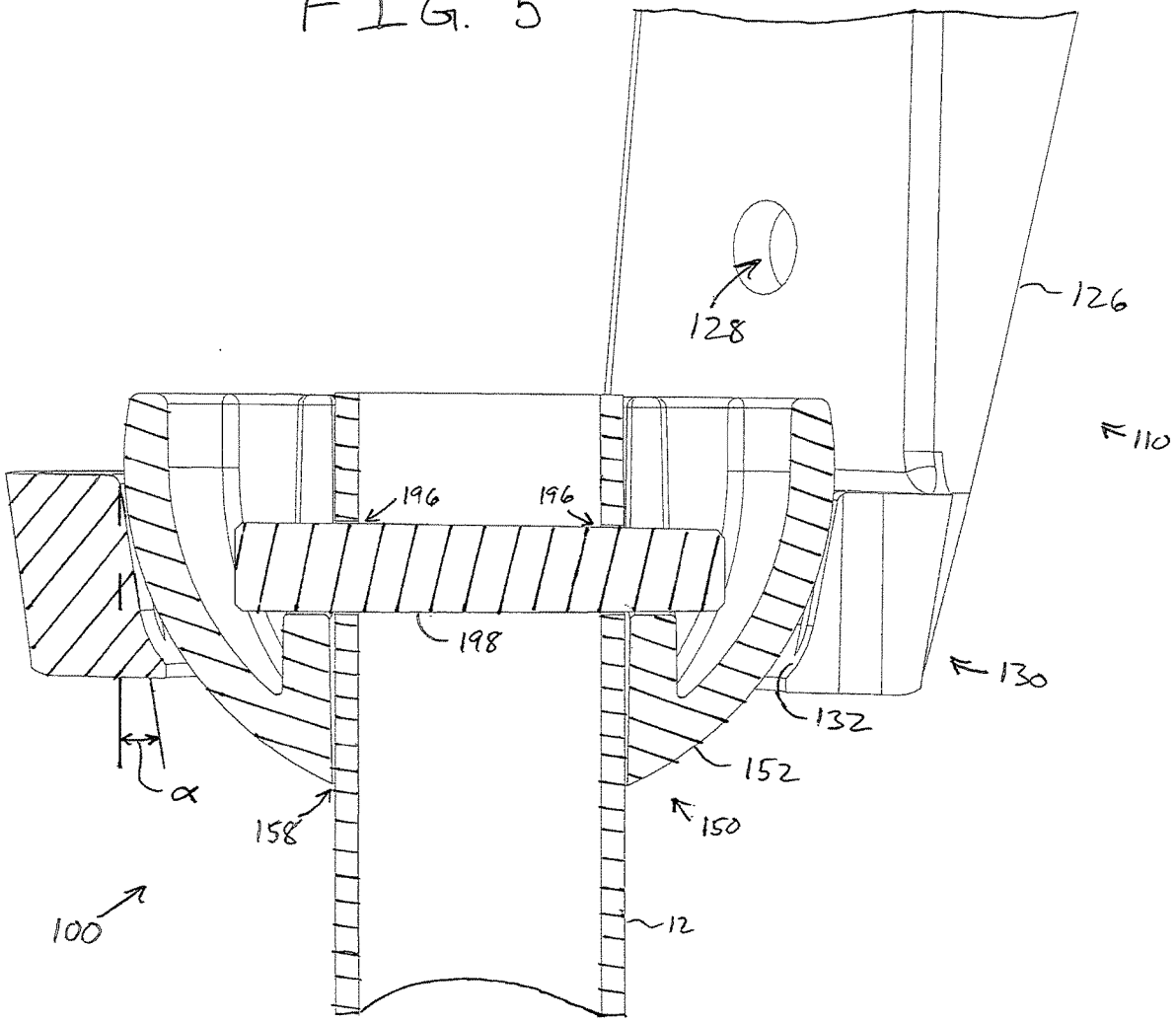
FIG. 5 depicts a partial cross-sectional view of the ball and socket mounting assembly taken along section line 5-5 in FIG. 3 showing the interface of an exemplary ball and exemplary conical socket.

As shown best in FIGS. 4-5, socket portion (130) comprises a C-shaped member coupled to stanchions (126). In the present example, socket portion (130) has an interior surface (132) configured to receive ball member (150) therein. Socket portion (130) also includes an open section (140) that permits ball member (150) and support (12), described in greater detail below, to be side loaded into socket portion (130) by passing support (12) through open section (140), though this is merely optional. In some versions, socket portion (130) may form a continuous annular member without open section (140). In the present example, interior surface (132) comprises a conical inwardly tapered surface, as best shown in FIG. 5. The conical taper of interior surface (132) comprises a substantially constant angle of taper α. As depicted in FIG. 5, the angle of taper α is approximately 10 degrees relative to the vertical plane, though this is merely optional. In some versions, the angle of taper α may comprise an angle of 5 degrees, inclusive, to 15 degrees, inclusive. It should be understood that the angle of taper α may comprise an angle of slightly greater than 0 degrees, inclusive, to slightly less than 90 degrees, inclusive. Of course it should be understood that interior surface (132) need not necessarily include a constant angle of taper α along the entirety of interior surface (132); rather, interior surface (132) may simply include a flat portion or segment that contacts ball member (150) at a desired point or points on an outer surface (152) of ball member (150). In some versions, interior surface (132) may comprise, at least in part, a concave semi-spherical surface that is complementary to ball member (150), though this is also optional. Still other geometrical arrangements for interior surface (132) will be apparent to one of ordinary skill in the art in view of the teachings herein.

Outer surface (152) of ball member (150) contacts interior surface (132) at a latitude on ball member (150) that is at an angle below the equatorial latitude of ball member (150) equal to the angle of taper α, which is approximately 10 degrees in this example, though this is also merely optional. It should be understood that, with a constant angle of taper α, the annular interface region of ball member (150) with interior surface (132) remains substantially constant even with minor size variations between ball member (150) and interior surface (132). The engagement of outer surface (152) with interior surface (132) in the present example occurs at a nearly vertical portion of each such that the surface area where the two surfaces (132, 152) engage is larger than if the engagement occurred at a lower angled region. Thus, the frictional resistance between the two surfaces (132, 152) is increased due to the mechanical advantage of the narrow angle taper α in socket portion (130), which causes the contact forces between ball member (150) and socket portion (130) to be greater than the weight of the supported load. For instance, the weight of fan (10) may create a wedging action between ball member (150) and interior surface (132) to provide resistance and/or damping to rotation and/or movement of ball member (150) relative to socket portion (130). Thus, this annular interface region of outer surface (152) of ball member (150) and interior surface (132) provides frictional resistance to the rotation and/or movement of ball member (150) relative to socket portion (130). Of course it should be understood that the foregoing is merely exemplary and, in some versions, lower angles and/or regions for engagement of the two surfaces (132, 152) may be used.

In addition, or in the alternative, interior surface (132) may include surface features that provide additional resistance to the rotation and/or movement of ball member (150). In the present example, a plurality of vertical channels (138) are disposed in an annular array about interior surface (132). Vertical channels (138) form discontinuity points about interior surface (132) such that the edges of vertical channels (138) provide additional resistance to the rotation and/or movement of ball member (150). In addition, or in the alternative, to vertical channels (138), other features may be provided on interior surface (132) as well. By way of example only, pebbling, scallops, dimples, divots, scoring, ridging, and/or other features for interior surface (132) will be apparent to one of ordinary skill in the art in view of the teachings herein. Moreover, in some versions, the material for socket portion (130) may comprise a material having a high coefficient of friction (e.g., rubber, latex, polymers, etc.) or may otherwise be selected to provide additional resistance to rotation and/or movement of ball member (150) relative to socket portion (130), though this is optional. It should be understood that the foregoing features of socket portion (130) are configured to resist slight and/or unintentional movement of ball member (150) relative to socket portion (130) while still permitting substantial intentional rotational freedom of ball member (150) relative to socket (130). For example, such features may provide resistance to, or damping of, swaying or oscillation of fan (10) caused by an imperfectly balanced fan (10) and/or features of fan (10) and/or where a slight breeze or impact moves fan (10). Of course still other configurations for socket portion (130) and/or mount (110) will be apparent to one of ordinary skill in the art in view of the teachings herein.

Figure 6:
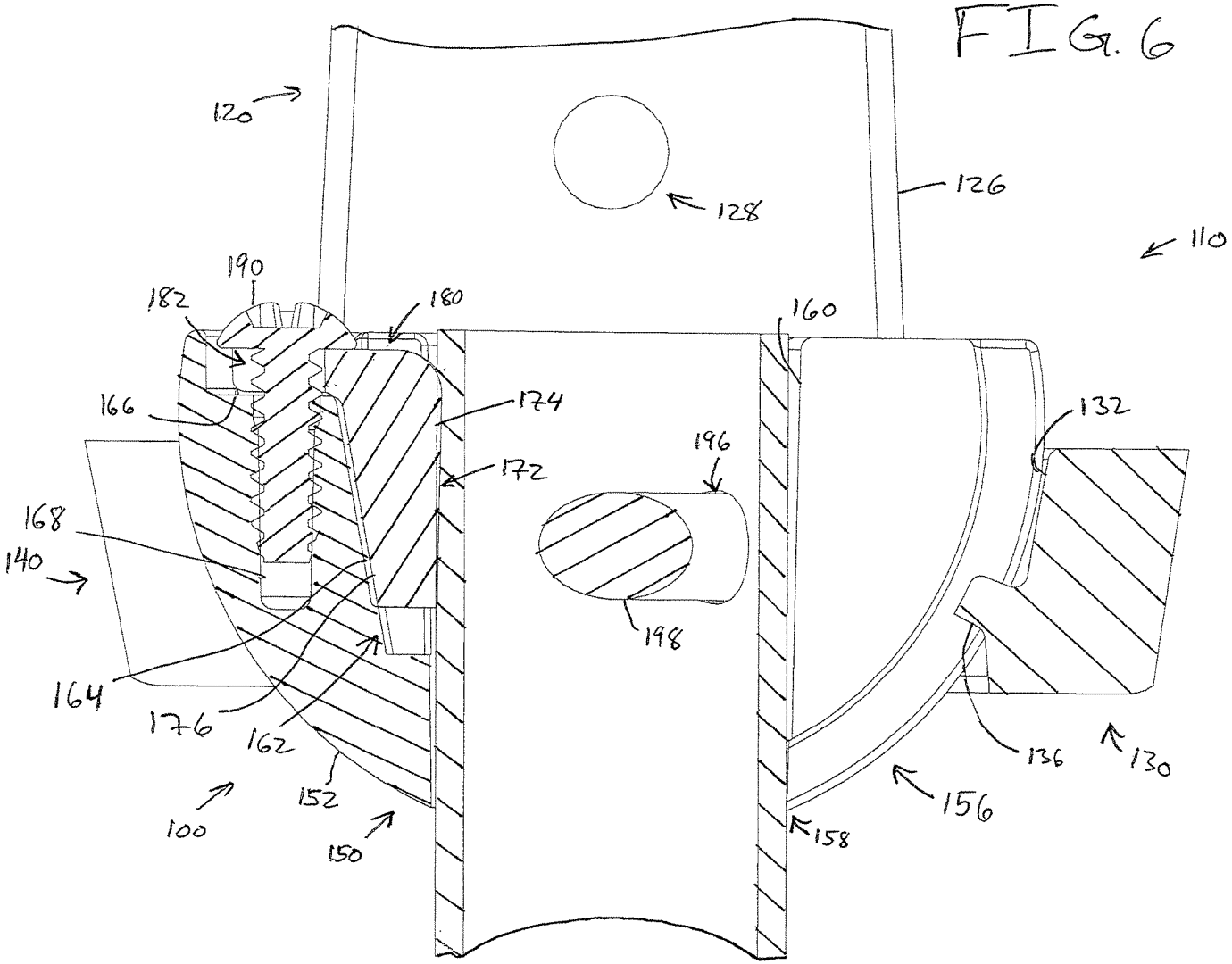
FIG. 6 depicts a partial cross-sectional view of the ball and socket mounting assembly taken along section line 6-6 in FIG. 3 with the socket omitted and showing an exemplary wedge.

As shown in FIG. 4, a tab (136) extends inwardly from interior surface (132) opposite of open section (140), though this is merely optional. In the present example, tab (136) is insertable into a channel (156) formed along a vertical portion of outer surface (152) of ball member (150), such as that shown in FIG. 6. Tab (136) of the present example is sized and vertically positioned relative to a lower surface of socket portion (130) such that tab (136) does not abut or otherwise interfere with support (12) when ball member (150) and support (12) are rotated within socket portion (130). Channel (156) of the present example comprises a groove or other indentation formed in ball member (150) that is sized to receive tab (136) therein. As shown in FIG. 6, channel (156) extends vertically along outer surface (152) of ball member (150) from a top portion of ball member (150) and terminates at an intersection with vertical passage (158) such that a curved channel is formed on ball member (150). With tab (136) inserted into channel (156), tab (136) resists rotation of ball member (150) about a vertical axis extending through support (12) while permitting ball member (150) to rotate within the plane formed by channel (156). Accordingly, in some versions, when motor (22) is running for a long period of time, tab (136) and channel (156) may cooperatively resist rotation of ball member (150) and support (12) relative to mount (110). Of course it should be understood that tab (136) and/or channel (156) may be omitted in some versions. Further configurations for tab (136) and/or channel (156) will be apparent to one of ordinary skill in the art in view of the teachings herein.

Referring back to FIGS. 3-4, ball member (150) is coupled to an end of support (12) that is opposite of fan (10). In the present example, ball member (150) comprises a polymer-based hemispherical ball having a vertical passage (158) extending through ball member (150) and configured to receive and secure support (12) therein, as will be described below. Ball member (150) is configured to interface with socket portion (130) and interior surface (132) to provide a rotatable joint. While interior surface (132) includes a number of features for providing frictional or other resistance to movement and/or rotation of ball member (150) relative to socket portion (130), in some versions ball member (150) may include one or more features to provide frictional or other resistance to movement and/or rotation of ball member (150) relative to socket portion (130) in addition or in the alternative to the features associated with interior surface (132). For instance, in some versions ball member (150) may include pebbling, scallops, dimples, divots, scoring, ridging, and/or other features on an outer surface (152) of ball member (150). In addition, or in the alternative, the material for ball member (150) and/or for a thin layer disposed on outer surface (152) may comprise a material having a relatively high coefficient of friction (e.g., rubber, latex, polymers, etc.) or may otherwise be selected to provide additional resistance to rotation and/or movement of ball member (150) relative to socket portion (130), though this is discretionary. As with the features of socket portion (130), it should be understood that the foregoing features of ball member (150) are configured to resist slight and/or unintentional movement of ball member (150) relative to socket portion (130) while still permitting substantial intentional rotational freedom of ball member (150) relative to socket (130). For example, such features may provide resistance to, or damping of, swaying or oscillation of fan (10) caused by an imperfectly balanced fan (10) and/or features of fan (10) and/or where a slight breeze or impact moves fan (10). Of course still other features for ball member (150) will be apparent to one of ordinary skill in the art in view of the teachings herein.

In the present example, the body of ball member (150) is generally hemispherical. It should be understood, however, that the body of ball member (150) need not necessarily be shaped like exactly half of a sphere, and may instead be shaped like any portion of a sphere. Furthermore, the body of ball member (150) may be shaped like an entire sphere. In view of this, use of terms such as "hemispherical" or "spherical" herein should not be read as being limited to exactly half of a sphere or a full sphere. A "spherical member" may in fact be shaped like just a hemisphere or some other portion of a full sphere. Similarly, a "partially spherical member" may in fact be shaped like a full sphere.

As noted above, support (12) is received in vertical passage (158) of ball member (150) such that support (12) is securely coupled to ball member (150). In the present example, support (12) includes a pair of transverse holes (196) that are configured to receive a pin (198) therein, as shown in FIG. 4. Ball member (150) includes a pair of transverse saddles (156) disposed on either side of vertical passage (158) such that each end of pin (198) rests within a corresponding saddle (156), as shown best in FIG. 5. Accordingly, when fan (10) is coupled to support (12), the weight of fan (10) urges pin (198) against saddles (156) to maintain pin (198) and support (12) engaged with ball member (150). In some versions, saddles (156) may include detents, clips, clamps, latches, and/or other features to retain each end of pin (198) within a corresponding saddle (156), though these are merely optional.

While support (12) is generally secured to ball member (150) via pin (198), in some versions, an imperfect fit between support (12) and vertical passage (158) may exist such that support (12) can move relative to ball member (150). Such movement may be undesirable for some fans and/or in some settings. As shown in FIG. 6, a wedge (170) and screw (190) are provided to lodge support (12) against a sidewall (160) of vertical passage (158) to reduce or eliminate the movement of support (12) relative to ball member (150). Wedge (170) of the present example comprises a wedge portion (172) and a securing portion (180). Wedge portion (172) comprises a vertical side (174) and an angled side (176). In the present example, vertical side (174) is configured to interface with support (12) as angled side (176) is urged inwardly via wedge recess (162), as described below. In some versions, vertical side (174) and/or an outer surface of support (12) may include pebbling, scallops, dimples, divots, scoring, ridging, and/or other features to provide additional resistance to movement of support (12) relative to ball member (150), though this is merely optional.

In the present example, angled side (176) forms an angle of approximately 10 degrees relative to vertical side (174), though this is merely optional. Of course it should be understood that angled side (176) may form and angle of slightly greater than 0 degrees, inclusive, to approximately 45 degrees, inclusive. Of course angles greater than 45 degrees may be used as well, as will be apparent to one of ordinary skill in the art in view of the teachings herein. Still other angular and/or other geometric relationships between angled side (176) and vertical side (174) will be apparent to one of ordinary skill in the art in view of the teachings herein. Securing portion (180) extends horizontally from the top of wedge portion (172) and includes a slot (182) configured to receive screw (190) therethrough. Wedge (170) may comprise a metallic member, a polymer member, a wooden member, and/or any other material as will be apparent to one of ordinary skill in the art in view of the teachings herein. Still other configurations and/or geometries for wedge (170) will be apparent to one of ordinary skill in the art in view of the teachings herein.

In the present example, ball member (150) includes a wedge recess (162) and a tapped hole (168) configured to cooperate with wedge (170) and screw (190) to secure support (12) relative to ball member (150). Wedge recess (162) comprises an angled or wedge shape recess that is sized to have a profile that is slightly smaller than the profile of wedge (170) such that wedge (170) drives support (12) laterally when wedge (170) is inserted into wedge recess (162). In the present example, wedge recess (162) includes an angled portion (164) and a flat portion (166). Angled portion (164) forms an angle of approximately 10 degrees relative to a vertical plane, though this is merely optional. Like angled side (176), angled portion (164) may form an angle of slightly greater than 0 degrees, inclusive, to approximately 45 degrees, inclusive. Of course angles greater than 45 degrees may be used as well. Still other angular and/or other geometric relationships for angled portion (164) will be apparent to one of ordinary skill in the art in view of the teachings herein.

As wedge (170) is urged downwardly relative to wedge recess (162), angled side (176) of wedge (170) interfaces with angled portion (164) of wedge recess (162) and drives wedge (170) laterally relative to wedge recess (162). Thus, as noted above, wedge recess (162) drives wedge (170) against support (12). Flat portion (166) extends horizontally relative to angled portion (164) and is configured to receive securing portion (180) therein. Flat portion (166) includes tapped hole (168) that receives screw (190) therein. As screw (190) tightens securing portion (180) downwardly toward flat portion (166), wedge (170) is driven toward support (12) to tighten support (12) relative to ball member (150). Thus, even if screw (190) and tapped hole (168) creep over time, wedge (170) remains substantially engaged with support (12) via the interface of angled side (176) and angled portion (164). In some versions, one or more set screws (not shown) may be provided through a transverse hole in ball member (150) to engage with support (12) to reduce or eliminate the movement of support (12) relative to ball member (150), though this is merely optional. In addition, or in the alternative, a screw or other fastener may be inserted vertically and parallel to support (12) such that a head of the screw and/or fastener restricts vertical movement of support (12) relative to ball member (150), though this is also optional. Of course still further features and/or configurations for securing support (12) to ball member (150) will be apparent to one of ordinary skill in the art in view of the teachings herein.

It should be understood that the foregoing features (e.g., the interface of wedge (170) and support (12), the interface of interior surface (132) of socket portion (130) with ball member (150), etc.) may be combined, either individually or with other features, with other mounting assemblies, as will be apparent to one of ordinary skill in the art in view of the teachings herein.

It should be appreciated that any patent, publication, or other disclosure material, in whole or in part, that is said to be incorporated by reference herein is incorporated herein only to the extent that the incorporated material does not conflict with existing definitions, statements, or other disclosure material set forth in this disclosure. As such, and to the extent necessary, the disclosure as explicitly set forth herein supersedes any conflicting material incorporated herein by reference. Any material, or portion thereof, that is said to be incorporated by reference herein, but which conflicts with existing definitions, statements, or other disclosure material set forth herein will only be incorporated to the extent that no conflict arises between that incorporated material and the existing disclosure material.

Having shown and described various embodiments of the present invention, further adaptations of the methods and systems described herein may be accomplished by appropriate modifications by one of ordinary skill in the art without departing from the scope of the present invention. Several of such potential modifications have been mentioned, and others will be apparent to those skilled in the art. For instance, the examples, embodiments, geometrics, materials, dimensions, ratios, steps, and the like discussed above are illustrative and are not necessarily required. Accordingly, the scope of the present invention should be considered in terms of the claims and is understood not to be limited to the details of structure and operation shown and described in the specification and drawings.

I claim:

1. A fan mounting apparatus, the apparatus comprising:

(a) a ball member, wherein the ball member has a spherical outer surface and an opening;

(b) a support, wherein the support is disposed within the opening of the ball member, wherein the support is coupled to the ball member, wherein the support is configured to couple with a fan; and (c) a mount, wherein the mount comprises:

(i) a mounting portion, and (ii) a socket portion, wherein the socket portion is configured to receive the ball member and the support, wherein the socket portion presents a tapered conical interior surface, and wherein the spherical outer surface of the ball member is configured to rest upon the tapered conical interior surface of the socket portion, and further comprising a wedge, wherein the ball member includes a tapered recess within an interior surface of the opening of the ball member, wherein the wedge is positioned in the tapered recess, and wherein the wedge is configured to exert an inwardly directed force upon an exterior surface of the support.

2. The apparatus of claim 1, wherein mounting portion of the mount comprises at least one mounting opening.

3. The apparatus of claim 2, wherein the at least one mounting opening comprises at least one slot.

4. The apparatus of claim 1, wherein the mounting portion and the socket portion are coupled together by at least one stanchion.

5. The apparatus of claim 1, wherein the socket portion further comprises a C-shaped member having an open portion configured to receive the ball member and support.

6. The apparatus of claim 1, wherein the taper of the tapered conical interior surface has a constant taper angle.

7. The apparatus of claim 6, wherein the taper angle is between 5 degrees and 15 degrees.

8. The apparatus of claim 1, wherein the tapered conical interior surface of the socket portion further comprises a plurality of frictional features configured to provide resistance against rotation of the ball member about an axis defined by the support within the socket portion.

9. The apparatus of claim 8, wherein the frictional features comprise vertical channels formed in the tapered conical interior surface.

10. The apparatus of claim 1, wherein the tapered conical interior surface of the socket portion and the spherical outer surface of the ball member are formed of materials to create a high coefficient of friction.

11. The apparatus of claim 1, wherein the tapered conical interior surface of the socket portion presents an inwardly directed tab, wherein the spherical outer surface of the ball member presents a recess, wherein the recess is configured to receive the tab, and wherein the tab and recess are configured to provide resistance against rotation of the ball member about an axis defined by the support within the socket portion.

12. The apparatus of claim 11, wherein the recess comprises a vertical channel.

13. The apparatus of claim 1, wherein the support comprises a pair of openings, wherein the openings are configured to receive a pin, wherein the ball member presents a pair of vertical channels, and wherein the pin is configured to be received within the pair of vertical channels.

14. The apparatus of claim 1, wherein an interior surface of the wedge comprises frictional features configured to provide resistance against movement of the support within the ball member.

15. The apparatus of claim 1, further comprising a threaded member, wherein the ball member further comprises a threaded opening, and wherein the wedge is configured to be driven into the tapered recess in response to rotation of the threaded member within the threaded opening.

16. The apparatus of claim 1, further comprising a fan coupled with the support, wherein the fan comprises a motor assembly, a hub assembly coupled with the motor assembly, and a plurality of fan blades coupled to the hub assembly.

* * * * *